US011250827B2

(12) United States Patent
Robotham

(10) Patent No.: US 11,250,827 B2
(45) Date of Patent: Feb. 15, 2022

(54) TEMPERATURE COMPENSATION FOR PIEZO SOUNDER

(71) Applicant: Carrier Corporation, Palm Beach Gardens, FL (US)

(72) Inventor: Martin Paul Robotham, Bradenton, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/982,200

(22) PCT Filed: Mar. 26, 2019

(86) PCT No.: PCT/US2019/024046
§ 371 (c)(1),
(2) Date: Sep. 18, 2020

(87) PCT Pub. No.: WO2019/191074
PCT Pub. Date: Oct. 3, 2019

(65) Prior Publication Data

US 2021/0035545 A1 Feb. 4, 2021

Related U.S. Application Data

(60) Provisional application No. 62/651,524, filed on Apr. 2, 2018, provisional application No. 62/650,709, filed on Mar. 30, 2018.

(51) Int. Cl.
*G10K 9/122* (2006.01)
*G08B 3/10* (2006.01)

(52) U.S. Cl.
CPC ..... *G10K 9/122* (2013.01); *G08B 3/10* (2013.01)

(58) Field of Classification Search
CPC ..... G10K 9/122; G08B 3/10
See application file for complete search history.

(56) References Cited

U.S. PATENT DOCUMENTS 3,743,868 A * 7/1973 Kawada ..... B06B 1/0261 310/318
4,228,379 A 10/1980 Guscott et al.
(Continued)

FOREIGN PATENT DOCUMENTS

| | | | |
|---|---|---|---|
| CN | 101315028 | A | 12/2008 |
| DE | 3536701 | A1 | 4/1987 |
| WO | 2012068023 | A1 | 5/2012 |

OTHER PUBLICATIONS

International Search Report of the International Searching Authority; International Application No. PCT/US2019/024046; International Filing Date: Mar. 26, 2019; dated Jul. 3, 2019; 5 pages.
(Continued)

*Primary Examiner* — Mohamed Barakat
(74) *Attorney, Agent, or Firm* — Cantor Colburn LLP

(57) ABSTRACT

A method of operating a sound generation mechanism includes determining a temperature of the sound generation mechanism, identifying a resonant frequency of the sound generation mechanism associated with the determined temperature, and communicating an excitation frequency to the sound generation mechanism. The excitation frequency is selected in response to the resonant frequency associated with the determined temperature. The sound generation mechanism is operated to produce one or more sounds.

14 Claims, 4 Drawing Sheets

(56) References Cited

U.S. PATENT DOCUMENTS

| | | | | |
|---|---|---|---|---|
| 4,541,731 | A | 9/1985 | Bell et al. | |
| 4,554,477 | A * | 11/1985 | Ratcliff | B06B 1/0284 310/26 |
| 6,515,548 | B2 | 2/2003 | Matsumoto et al. | |
| 6,936,954 | B2 | 8/2005 | Peczalski | |
| 7,292,117 | B2 | 11/2007 | Ishikawa et al. | |
| 7,868,522 | B2 | 1/2011 | Ruby | |
| 7,884,529 | B2 | 2/2011 | Johnson et al. | |
| 8,284,982 | B2 | 10/2012 | Bailey | |
| 8,908,889 | B2 | 12/2014 | Lautzenhiser et al. | |
| 9,276,191 | B2 | 3/2016 | Ando et al. | |
| 9,444,426 | B2 | 9/2016 | Burak et al. | |
| 9,450,167 | B2 | 9/2016 | Zou et al. | |
| 9,565,496 | B2 | 2/2017 | Konno et al. | |
| 10,338,883 | B2 * | 7/2019 | Risberg | H04R 3/04 |
| 2013/0081470 | A1 | 4/2013 | Kim et al. | |
| 2013/0259245 | A1 * | 10/2013 | Cheng | H04R 3/00 381/58 |
| 2014/0010673 | A1 * | 1/2014 | Locke | F04B 43/04 417/53 |
| 2014/0161278 | A1 * | 6/2014 | Konno | H04R 17/10 381/94.2 |
| 2015/0221188 | A1 | 8/2015 | Wan | |
| 2015/0263697 | A1 | 9/2015 | Zhang et al. | |
| 2016/0258803 | A1 * | 9/2016 | Motomiya | G01F 23/2967 |

OTHER PUBLICATIONS

Written Opinion of the International Searching Authority; International Application No. PCT/US2019/024046; International Filing Date: Mar. 26, 2019; dated Jul. 3, 2019; 8 pages.

* cited by examiner

TEMPERATURE COMPENSATION FOR PIEZO SOUNDER

CROSS REFERENCE TO RELATED APPLICATIONS

This application is a National Stage application of PCT/US2019/024046 filed Mar. 26, 2019, which claims priority to U.S. Provisional application 62/650,709 filed Mar. 30, 2018 and U.S. Provisional application 62/651,524 filed Apr. 2, 2018, all of which are incorporated by reference in their entirety herein.

BACKGROUND

Embodiments of the disclosure relate to a notification devices and, more particularly, to a method for optimizing the sound pressure level of a piezoelectric horn of a notification device by adjusting its drive frequency in response to changes in temperature.

Typical building fire alarm systems include a number of fire detectors positioned throughout a building. Signals from those detectors are monitored by a system controller, which, upon sensing an alarm condition, initiates operation of one or more notification devices to provide an audio or visual alarm indication to persons within the building. Speakers or horns used in notification devices are typically required to be relatively compact, but capable of producing sound with a suitable intensity within the hearing range of the human ear. The sound output level and current draw are key performance metrics for such a sound generation device.

A piezo sounder is a high intensity sound source usable in a notification device. The piezo sounder is both cost effective and power efficient. However, piezo sounders may experience an adverse loss in sound level as the temperature of the notification appliance departs from a nominal temperature of about 25° C. More specifically, the resonance and drive frequencies associated with operation of a piezo sounder are designed to match at the nominal temperature. However, these frequencies tend to drift apart as the temperature deviates, both increases and decreases, relative to the nominal value. The greater the mismatch between the resonance and drive frequencies, the greater the loss in sound pressure level generated by the piezo sounder.

BRIEF DESCRIPTION

According to one embodiment, a method of operating a sound generation mechanism includes determining a temperature of the sound generation mechanism, identifying a resonant frequency of the sound generation mechanism associated with the determined temperature, and communicating an excitation frequency to the sound generation mechanism. The excitation frequency is selected in response to the resonant frequency associated with the determined temperature. The sound generation mechanism is operated to produce one or more sounds.

In addition to one or more of the features described above, or as an alternative, in further embodiments the excitation frequency is generally equal to the identified resonant frequency associated with the determined temperature.

In addition to one or more of the features described above, or as an alternative, in further embodiments the excitation frequency communicated to the sound generation mechanism varies based on the determined temperature.

In addition to one or more of the features described above, or as an alternative, in further embodiments the excitation frequency is selected to minimize a difference between the identified resonant frequency associated with the determined temperature and the excitation frequency.

In addition to one or more of the features described above, or as an alternative, in further embodiments determining the temperature of the sound generation mechanism includes sensing a temperature of an environment surrounding the sound generation mechanism.

In addition to one or more of the features described above, or as an alternative, in further embodiments determining the temperature of the sound generation mechanism includes sensing a temperature of one or more components of the sound generation mechanism directly.

In addition to one or more of the features described above, or as an alternative, in further embodiments determining the temperature of the sound generation mechanism includes inferring a temperature of the sound generation mechanism from other available data.

In addition to one or more of the features described above, or as an alternative, in further embodiments identifying the resonant frequency of the sound generation mechanism associated with the sensed temperature includes selecting a stored value of the resonant frequency from a database.

In addition to one or more of the features described above, or as an alternative, in further embodiments identifying a resonant frequency of the sound generation mechanism associated with the sensed temperature includes calculating the resonant frequency in response to the determined temperature.

In addition to one or more of the features described above, or as an alternative, in further embodiments the sound generation mechanism is a piezoelectric sounder and communicating the excitation frequency to the sound generation mechanism further comprises communicating the excitation frequency to a piezoelectric diaphragm of the piezoelectric sounder.

In addition to one or more of the features described above, or as an alternative, in further embodiments comprising a sound driver for communicating the excitation frequency to the sound generation mechanism.

According to another embodiment, a notification device includes a sound generation mechanism configured to generate sound waves and a notification horn circuit including a sound driver operable to supply a voltage to the sound generation mechanism to generate one or more sound waves. An excitation frequency associated with the voltage supplied to the sound generation mechanism is selected based on a resonant frequency and the resonant frequency is determined based on a temperature of the sound generation mechanism.

In addition to one or more of the features described above, or as an alternative, in further embodiments the excitation frequency is selected to maximize a sound pressure level of the sound waves at the temperature.

In addition to one or more of the features described above, or as an alternative, in further embodiments the excitation frequency is selected to reduce a difference between the resonant frequency and the excitation frequency at the temperature.

In addition to one or more of the features described above, or as an alternative, in further embodiments the excitation frequency selected is generally equal to the resonant frequency at the temperature.

In addition to one or more of the features described above, or as an alternative, in further embodiments the sound generation mechanism is operable over a range of temperatures.

In addition to one or more of the features described above, or as an alternative, in further embodiments the sound generation mechanism includes a piezoelectric sounder.

In addition to one or more of the features described above, or as an alternative, in further embodiments comprising a module for determining the temperature of the sound generation mechanism.

In addition to one or more of the features described above, or as an alternative, in further embodiments the module for determining the temperature of the sound generation mechanism includes a temperature sensor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
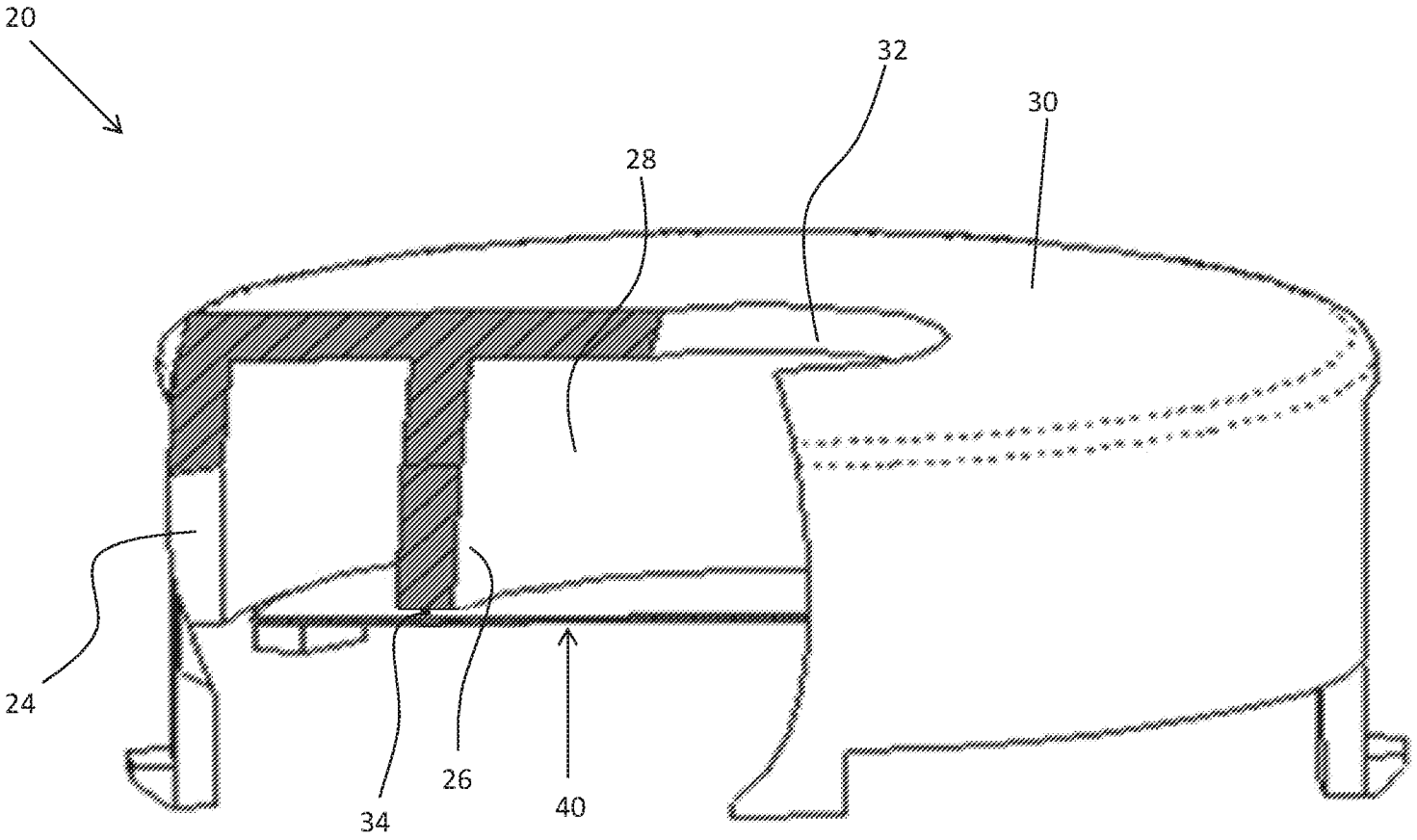
FIG. 1 is a perspective view of a piezoelectric sounder.

With reference now to FIG. 1, an example of a piezoelectric sounder 20 of a notification device (not shown) is illustrated. The sounder 20 includes an outer curved wall 24. One or more curved inner walls 26 disposed inwardly of the outer wall 24 form a boundary of a resonant chamber 28. The sounder 20 additionally includes a cover 30 oriented generally perpendicular to the outer wall 24 and the inner wall 26. As shown, the cover 30 forms the top wall of the resonant chamber 28. A sound port 32 is formed in the cover at a central portion of the resonant chamber 28. Mounted adjacent an opposite surface of the resonant chamber 28 is a piezoelectric diaphragm 40. In an embodiment, the piezoelectric diaphragm 40 forms a narrow point of contact with the inner wall 26, illustrated at 34. In an embodiment, this narrow point of contact may be located at a central portion of the piezoelectric diaphragm 40, such as at a location about 60% of the radius of the diaphragm for example, and may extend around an annulus.

Figure 2:
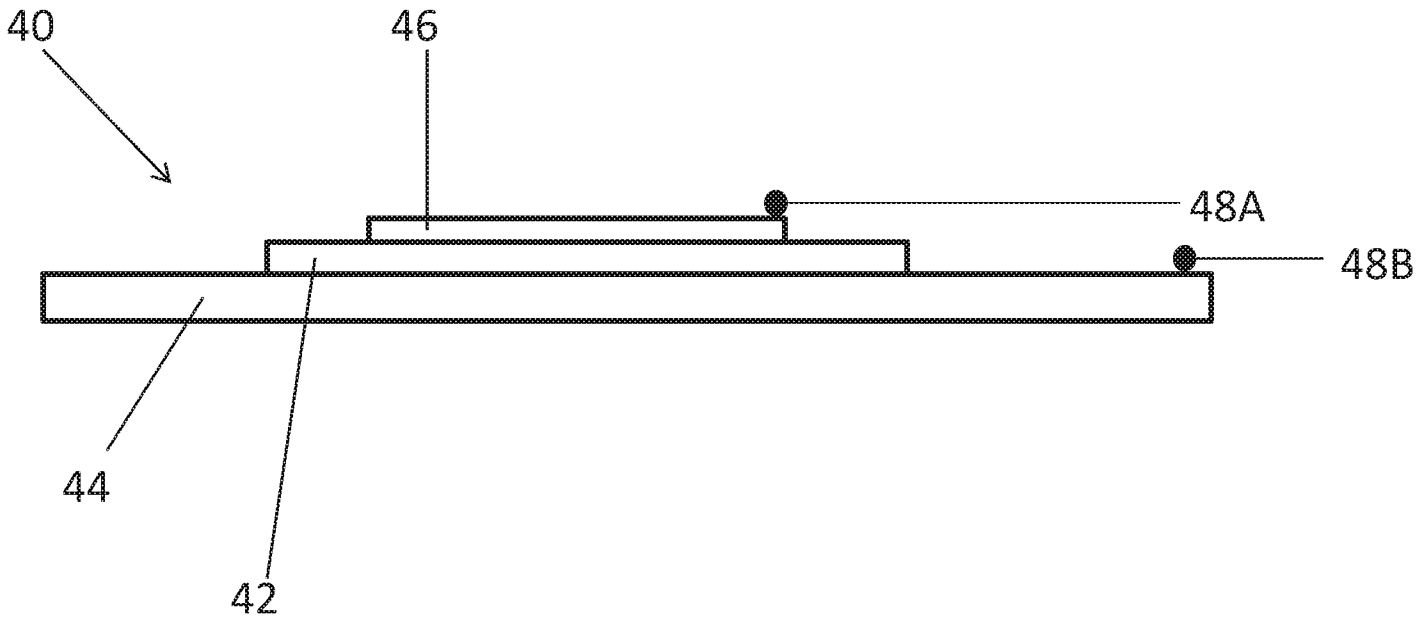
FIG. 2 is a side view of a piezoelectric diaphragm of a piezoelectric sounder.

As best shown in FIG. 2, the sounder 20 includes a piezoelectric diaphragm 40 including a piezoelectric material 42 positioned in overlapping arrangement with a plate 44. The piezoelectric material 42 may include any suitable material having piezoelectric properties, such as a piezoelectric ceramic for example. The plate 44 may be formed from any suitable material, including but not limited to a metal, such as brass for example. As shown, the piezoelectric material 42 is disposed centrally on the plate 44 and is suitably secured thereto. An electrode 46 may be positioned in overlapping arrangement with a portion of the piezoelectric material 42, such that the piezoelectric material 42 is at least partially sandwiched between the electrode and the plate. In such embodiments, the plate 44 is configured as a second electrode and electrical input lines 48A, 48B extend from the first and second electrodes 46, 44, respectively. A voltage is applied to the piezoelectric material 42 via the electric input lines 48A, 48B.

When a voltage having a first polarity is applied to the piezoelectric diaphragm 40, the diaphragm 40 bends in a first direction. Similarly, when a voltage having a second polarity is applied to the piezoelectric diaphragm 40, the diaphragm 40 bends in a second, opposite direction Accordingly, when an oscillating electrical signal is applied to the piezoelectric diaphragm 40, the piezoelectric diaphragm 40 vibrates in a repeated bending mode, causing the piezoelectric material 42 to change shape and generate sound waves by this movement. The sound waves generated will travel from resonant chamber 28 into the atmosphere via the sound port 32 formed in the top wall 30 of the resonant chamber 28. The chamber 28 allows resonance to occur at certain frequencies based on the chamber volume, port volume, and the mass and resilience of the fluid within the chamber. It should be understood that the sounder 20 and the piezoelectric diaphragm 40, illustrated and described herein are intended as an example only and that other configurations of a piezoelectric sounder for use in a notification device are also within the scope of the disclosure.

Figure 3:
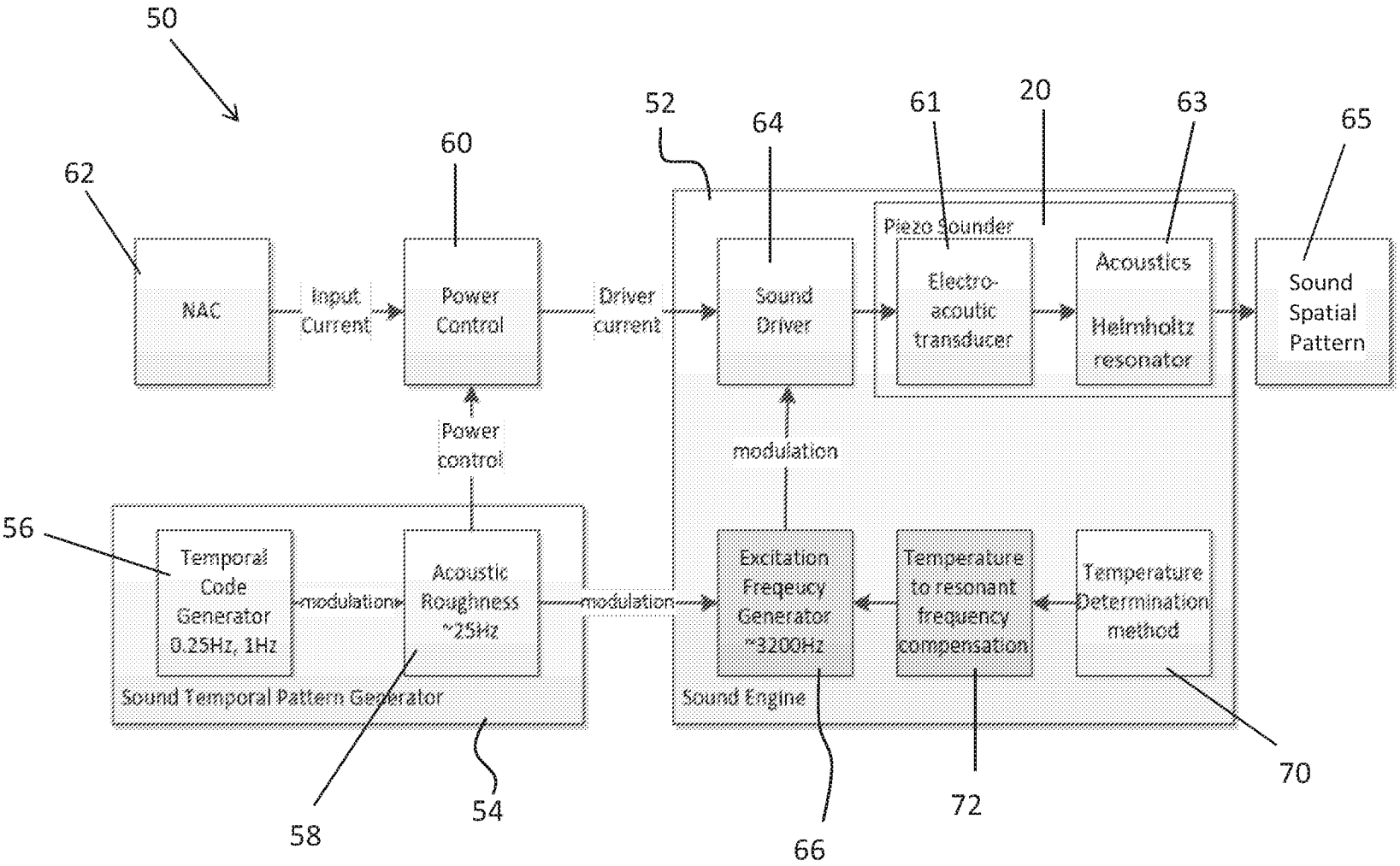
FIG. 3 is a block diagram of a notification horn circuit of a piezoelectric sounder according to an embodiment.

With reference now to FIG. 3, an example of a notification horn circuit 50 for operating a piezoelectric sounder, such as sounder 20 for example, is illustrated. As shown, the notification horn circuit 50 includes a sound engine 52 operable to generate and form an acoustic signal and a sound temporal pattern generator 54 responsible for generating one or more frequencies. In the illustrated, non-limiting embodiment, the sound temporal pattern generator 54 includes a temporal code generator 56 and a module for generating acoustic roughness 58. The temporal code generator 56 is configured to generate a temporal code to indicate the presence of an alarm. In an embodiment, the code includes a combination of acoustic pulses separated by pauses or periods of silence, and each of the pulses and pauses may last for identical or varying lengths of time. An example of a code generated by the temporal code generator 56 includes a "fire pattern" consisting of a first pulse on for a half second, a first pause for a half second, a second pulse on for a half second, a second pause for a half second, a third pulse on for a half second, a third pause for a half second followed by a 1 second pause. Alternatively, the code generator 56 may generate a continuous "alarm tone."

The code generated by the temporal code generator 56 is communicated to the acoustic roughness module 58. Within the acoustic roughness module 58, a special modulation of the code is performed. This modulation is intended to enhance the ability of the sound wave being generated to attract attention. In an embodiment, the acoustic roughness module 58 is configured to modulate the waveform to mimic that of a human scream by including an additional low frequency into the temporal pattern.

A signal including a combination of the code and the acoustic roughness to be applied thereto is provided to a power control module 60 in communication with the sound engine 52. As shown, the power control module 60 receives an input current from a notification appliance circuit 62 of an alarm system and communicates a drive current to a sound driver 64 of the sound engine 52. In addition, the acoustic roughness module 58 simultaneously communicates the combination of the temporal code and the acoustic roughness to an excitation frequency generator 66 of the sound engine 52.

The excitation frequency generator 66 typically communicates the temporal code, the acoustic roughness, and an excitation frequency, such as 3.2 kHz for example, to the sound driver 64. The sound driver 64, powered by the drive current from the power control 60, uses this information to supply power to the piezoelectric sounder 20, and more specifically to the piezoelectric diaphragm 40, to generate a desired acoustic pattern and frequency, illustrated schematically at 65. In the illustrated, non-limiting embodiment, the piezoelectric sounder 20 is shown including an electro-acoustic transducer 61 and an acoustics Helmholtz resonator 63. However, it should be understood that a piezoelectric sounder 20 having another suitable configuration is also within the scope of the disclosure.

Figure 4:
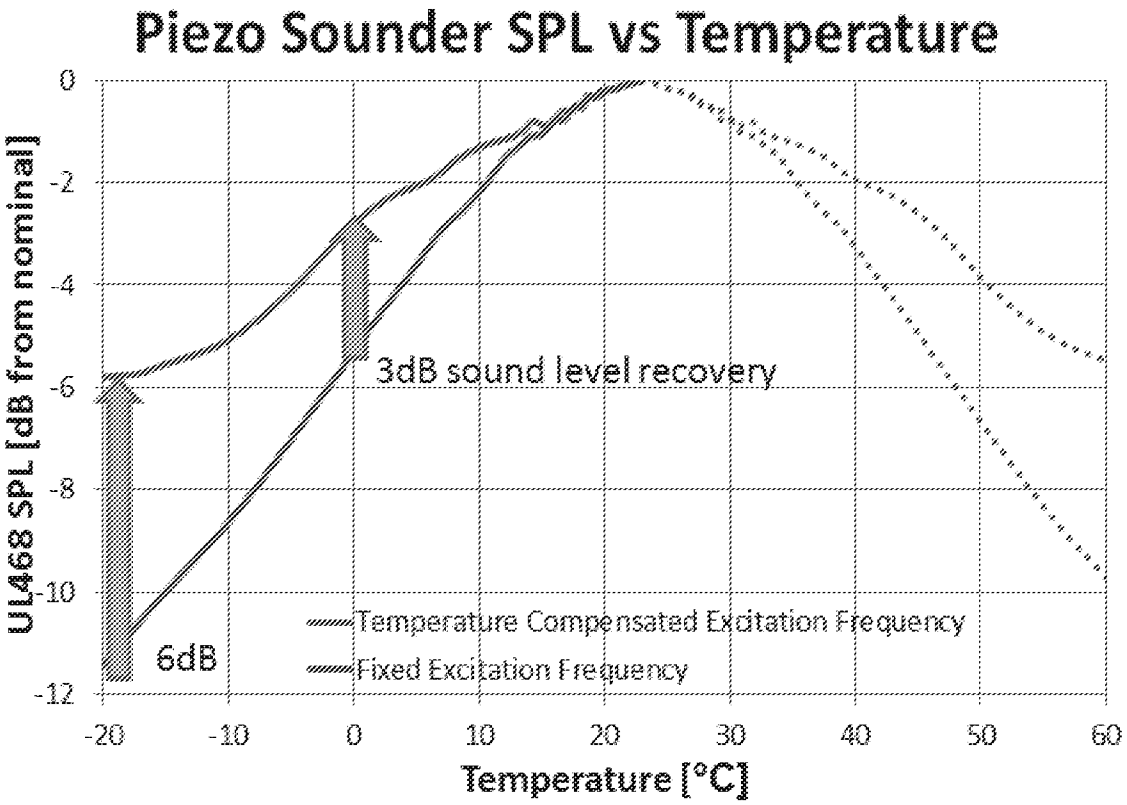
FIG. 4 is a graph comparing the sound pressure level of the piezoelectric sounder at various temperatures during normal operation and when operated to include temperature compensation according to an embodiment.

With reference to FIG. 4, a maximum sound pressure level is achieved by the sounder 20 when the resonance frequency of the sounder 20 and the excitation frequency generated by the excitation frequency generator 66 match. In an embodiment, the sounder 20 is typically designed such that the resonance frequency and the excitation frequencies match when the sounder 20 is at a nominal temperature of about 25° C. or room temperature. It can be seen from the graph that the sound pressure level output from a piezoelectric sounder 20 at a fixed excitation frequency varies in response to the temperature of the sounder 20. Accordingly, the resonant frequency of the resonant chamber 28 of the sounder 20 varies with temperature. As shown, the sound pressure level output from the sounder 20 gradually reduces as the temperature of the sounder 20 deviates from this nominal temperature due to an increasing discrepancy or mismatch between the resonance frequency and the excitation frequency.

Accordingly, the sound pressure level output by the sounder 20 may be enhanced by determining the temperature of the sounder 20 and compensating for the difference between the identified temperature and the nominal temperature of the sounder 20. With reference again to FIG. 3, the sound engine 52 of the notification horn circuit 50 additionally includes module 70 for determining the temperature of the sounder 20. In an embodiment, the module 70 includes a sensor for monitoring the ambient temperature surrounding the sounder 20. However, any suitable mechanism for detecting the temperature of the sounder 20 itself (or one or more of its components), or the environment surrounding the sounder 20 is contemplated herein. Alternatively, the module 70 may estimate or infer the temperature of the sounder 20 from other available data, such as from power consumption of the sounder 20 for example.

The sound engine 52 additionally includes a resonant frequency compensation module, illustrated schematically at 72, configured to identify the resonant frequency associated with the sensed temperature. In an embodiment, the resonant frequency compensation module 72 includes or is able to access a stored database or table identifying a resonant frequency of the sounder 20 associated with various temperatures within a temperature range. Alternatively, or in addition, the module 72 may be able to determine, such as via an algorithm or other calculation for example, the resonant frequency of the sounder 20 using the temperature identified by the temperature determination module 70.

The resonant frequency identified by the resonant frequency compensation module 72 indicates the ideal frequency provided by the excitation frequency generator so that the resonant frequency of the sounder 20 at the identified temperature and the excitation frequency generally match. Accordingly, the excitation frequency is adjusted to reduce or eliminate the difference between the resonant frequency and the excitation frequency at a given temperature. The resonant frequency identified by the module 72 is communicated to the excitation frequency generator 66. The excitation frequency generator 66 will identify the closest possible excitation frequency available and communicate that to the sound driver 64 for implementation during operation of the piezoelectric diaphragm 40. Although the compensation system and method is illustrated and described herein with respect to a sounder, it should be understood that the system and method may be adapted for use with any sound generation mechanism where the sound output therefrom may vary significantly depending on temperature.

By adjusting the excitation frequency of the sounder to compensate for changes in the resonant frequency based on the temperature of the sounder 20, increased sound pressure levels of up to 6 dB or more may be achieved over an operational temperature range experienced by the sounder 20. In addition, this increase in sound pressure level is achieved without an increase to the rated power consumption of the sounder 20, thereby enhancing the efficiency of operation of the sounder 20.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of operating a sound generation mechanism comprising:

measuring, via a temperature sensor, a temperature of at least one of the sound generation mechanism and an environment surrounding the sound generation mechanism;

identifying, via a stored database, a resonant frequency of the sound generation mechanism in response to the measured temperature;

selecting an excitation frequency from a plurality of available excitation frequencies, wherein the excitation frequency is selected to minimize a difference between the excitation frequency and the identified resonant frequency;

communicating the excitation frequency to the sound generation mechanism; and operating the sound generation mechanism to produce one or more sounds.

2. The method of claim 1, wherein the excitation frequency is generally equal to the identified resonant frequency associated with the determined temperature.

3. The method of claim 1, wherein the excitation frequency communicated to the sound generation mechanism varies based on the determined temperature.

4. The method of claim 2, wherein the excitation frequency is selected to minimize a difference between the identified resonant frequency associated with the determined temperature and the excitation frequency.

5. The method of claim 1, wherein identifying the resonant frequency of the sound generation mechanism associated with the sensed temperature includes selecting a stored value of the resonant frequency from a database.

6. The method of claim 1, wherein identifying the resonant frequency of the sound generation mechanism associated with the sensed temperature includes using an algorithm to calculate the resonant frequency using the determined temperature.

7. The method of claim 1, wherein the sound generation mechanism is a piezoelectric sounder and communicating the excitation frequency to the sound generation mechanism further comprises communicating the excitation frequency to a piezoelectric diaphragm of the piezoelectric sounder.

8. The method of claim 1, further comprising a sound driver for communicating the excitation frequency to the sound generation mechanism.

9. A notification device comprising:

a sound generation mechanism configured to generate sound waves;

a notification horn circuit including:

a sound driver operable to supply a voltage to the sound generation mechanism to generate one or more sound waves;

a temperature module including a temperature sensor operable to measure a temperature of at least one of the sound generation mechanism and an environment surrounding the sound generation mechanism;

a resonant frequency module configured to identify a resonant frequency of the sound generation mechanism from a stored database based on the measured temperature; and an excitation frequency generator operably coupled to the sound driver, wherein an excitation frequency associated with the voltage supplied to the sound generation mechanism is selected from a plurality of available excitation frequencies to minimize a difference between the selected excitation frequency and the resonant frequency identified by the resonant frequency module.

10. The notification device of claim 9, wherein the excitation frequency is selected to maximize a sound pressure level of the sound waves at the temperature.

11. The notification device of claim 9, wherein the excitation frequency is selected to reduce a difference between the resonant frequency and the excitation frequency at the temperature.

12. The notification device of claim 11, wherein the excitation frequency selected is generally equal to the resonant frequency at the temperature.

13. The notification device of claim 9, wherein the sound generation mechanism is operable over a range of temperatures.

14. The notification device of claim 9, wherein the sound generation mechanism includes a piezoelectric sounder.

* * * * *